US012760386B2

(12) United States Patent
Cho et al.

(10) Patent No.: US 12,760,386 B2
(45) Date of Patent: Oct. 13, 2026

(54) STEEL SHEET FOR SEISMIC DAMPER HAVING SUPERIOR TOUGHNESS PROPERTY AND MANUFACTURING METHOD OF SAME

(71) Applicant: POSCO CO., LTD, Pohang-si (KR)

(72) Inventors: Jae-Young Cho, Seoul (KR); Sang-Deok Kang, Gwangyang-si (KR); Kyung-Tae Kim, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 475 days.

(21) Appl. No.: 18/267,674

(22) PCT Filed: Nov. 30, 2021

(86) PCT No.: PCT/KR2021/017872
§ 371 (c)(1),
(2) Date: Jun. 15, 2023

(87) PCT Pub. No.: WO2022/131618
PCT Pub. Date: Jun. 23, 2022

(65) Prior Publication Data

US 2024/0052451 A1 Feb. 15, 2024

(30) Foreign Application Priority Data

Dec. 18, 2020 (KR) ..... 10-2020-0179049

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/005* (2013.01); *C21D 6/008* (2013.01); *C21D 8/02* (2013.01);
(Continued)

(58) Field of Classification Search
None
See application file for complete search history.

(56) References Cited

U.S. PATENT DOCUMENTS

2009/0229710 A1* 9/2009 Kuroda ..... C22C 38/02 148/287
2010/0040872 A1* 2/2010 Murakami ..... C22C 38/04 148/648
(Continued)

FOREIGN PATENT DOCUMENTS

CA 2 896 531 A1 7/2014
CN 101775535 A 7/2010
(Continued)

OTHER PUBLICATIONS

International Search Report for PCT/KR2021/017872 dated Mar. 29, 2022.
(Continued)

*Primary Examiner* — Seth Dumbris
(74) *Attorney, Agent, or Firm* — Sughrue Mion, PLLC

(57) ABSTRACT

The present invention relates to: a steel sheet for a seismic damper used to provide a structure with seismic resistance against earthquakes; and a manufacturing method of same, and more specifically, to a steel sheet which is for a seismic damper and has a superior toughness property, and a manufacturing method of same.

11 Claims, 3 Drawing Sheets

(51) Int. Cl.

| | |
|---|---|
| ***C21D 8/02*** | (2006.01) |
| ***C21D 8/0221*** | (2026.01) |
| ***C21D 8/0278*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(52) U.S. Cl.
CPC ..... *C21D 8/0226* (2013.01); *C21D 8/0278* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/005* (2013.01)

(56) References Cited

U.S. PATENT DOCUMENTS

| | | | | |
|---|---|---|---|---|
| 2010/0323194 | A1 | 12/2010 | Matsuda et al. | |
| 2017/0292171 | A1* | 10/2017 | Matsuda | C22C 38/00 |
| 2018/0245637 | A1* | 8/2018 | Oyagi | F16C 33/12 |
| 2022/0251693 | A1* | 8/2022 | Sakakibara | C22C 38/002 |

FOREIGN PATENT DOCUMENTS

| | | | | |
|---|---|---|---|---|
| CN | 103710622 | A | | 4/2014 |
| CN | 106636924 | A | | 5/2017 |
| CN | 108291282 | A | | 7/2018 |
| CN | 209674071 | U | | 11/2019 |
| JP | 11343537 | A | | 12/1999 |
| JP | 2000-109953 | A | | 4/2000 |
| JP | 2001-279324 | A | | 10/2001 |
| JP | 2004-339548 | A | | 12/2004 |
| JP | 2006-124773 | A | | 5/2006 |
| JP | 2007284748 | A | * | 11/2007 |
| JP | 2008248290 | A | | 10/2008 |
| JP | 2011-189394 | A | | 9/2011 |
| JP | 2011-202231 | A | | 10/2011 |
| JP | 2013-237101 | A | | 11/2013 |
| KR | 10-2004-0059995 | A | | 7/2004 |
| KR | 10-2008-0088605 | A | | 10/2008 |

OTHER PUBLICATIONS

Written Opinion for PCT/KR2021/017872 dated Mar. 29, 2022.
Communication dated Mar. 21, 2025 in Chinese Application No. 202180084766.0.
Communication dated Aug. 6, 2024 issued by the Japanese Patent Office in application No. 2023-535596.
Chinese Office Action dated Oct. 16, 2025 in Application No. 202180084766.0.

* cited by examiner

STEEL SHEET FOR SEISMIC DAMPER HAVING SUPERIOR TOUGHNESS PROPERTY AND MANUFACTURING METHOD OF SAME

CROSS REFERENCE TO RELATED APPLICATIONS

This application is a National Stage of International Application No. PCT/KR2021/017872 filed Nov. 30, 2021, claiming priority based on Korean Patent Application No. 10-2020-0179049 filed Dec. 18, 2020, the entire disclosures of which are incorporated herein by reference.

TECHNICAL FIELD

The present disclosure relates to a steel material for a seismic damper used to secure seismic resistance of a structure against an earthquake and a manufacturing method of the same.

BACKGROUND ART

In seismic design, which has been mainly used in Korea in the past, a technology of lowering a yield ratio of a steel material used in a structure of a column or beam during an earthquake to delay a point in time at which destruction of the structure occurs, was mainly used. However, the seismic design using such a steel material having a low yield ratio had a problem in that it is impossible to reuse the steel material used in the structure, and the structure itself should be reconstructed due to the absence of securing stability.

Recently, with the development of seismic design technology, a practical use of a seismic damping or vibration damping structure is progressing. In particular, various technologies for securing seismic performance by absorbing energy applied to a structure by an earthquake to a specific portion thereof are being developed. A seismic damper is used as a device for absorbing such seismic energy, and a steel material for a seismic damper has an ultra-low yield point characteristic. By lowering a yield point of the steel material for the seismic damper further than the existing structural material of a column or a beam, the steel material first yields during an earthquake to absorb vibration energy caused by the earthquake, and suppresses deformation of the structure by maintaining other structural materials within a range of elasticity.

However, the conventional steel material for the seismic damper utilizes ultra-low carbon steel to have a coarse ferrite structure, thereby exhibiting continuous yield behavior in which a yield point phenomenon is not exhibited during a tensile test. For this reason, while absorbing plastic strain energy generated by the earthquake, work hardening occurs rapidly, and the increase in yield strength is large, so there is a problem to be improved as a steel material for a damper for absorbing earthquake energy.

However, a technology at a level capable of meeting such high-end demand has not been developed so far.

(Patent Document 1) Patent Publication No. 2008-0088605

SUMMARY OF INVENTION

Technical Problem

An aspect of the present disclosure is to provide a steel sheet for a seismic damper, which has a low yield strength and can be used to secure seismic resistance of a structure against an earthquake and a manufacturing method of the same.

Alternatively, an aspect of the present disclosure is to provide a steel sheet for a seismic damper having a low yield strength and excellent low-temperature impact toughness simultaneously, and a manufacturing method of the same.

An object of the present disclosure is not limited to the above description. The object of the present disclosure will be understood from the entire content of the present specification, and a person skilled in the art to which the present disclosure pertains will understand an additional object of the present disclosure without difficulty.

Solution to Problem

According to an aspect of the present disclosure, provided is a steel sheet for a seismic damper, the steel sheet including: a base steel sheet; and a scale layer formed on at least one surface of the base steel sheet, wherein the base steel sheet includes, by wt %, 0.005 to 0.02% of C, 0.05 to 0.2% of Si, 0.1 to 0.5% of Mn, 0.02% or less of P, 0.01% or less of S, 0.005 to 0.05% of Al, 0.005% or less of N, 0.02 to 0.06% of Nb, 48/14×[N] to 0.05% of Ti, with a balance of Fe and other unavoidable impurities, wherein the base steel sheet includes, by area fraction, 95% or more of ferrite as a microstructure, wherein a total content of FeO and $Fe_2SiO_4$ in the scale layer is 2 to 5%, by wt %.

According to another aspect of the present disclosure, provided is a manufacturing method of a steel sheet for a seismic damper, the method including:

reheating a steel slab including, by wt %, 0.005 to 0.02% of C, 0.05 to 0.2% of Si, 0.1 to 0.5% of Mn, 0.02% or less of P, 0.01% or less of S, 0.005 to 0.05% of Al, 0.005% or less of N, 0.02 to 0.06% of Nb, 48/14×[N] to 0.05% of Ti, with a balance of Fe and other unavoidable impurities, to a temperature within a range of 1050 to 1250° C.;

subjecting the reheated steel slab to rough rolling at a temperature of Tnr+50° C. or higher, to obtain a rough-rolled bar; and hot rolling the rough-rolled bar at Tnr or higher, to obtain a hot-rolled steel sheet.

Advantageous Effects of Invention

As set forth above, according to an aspect of the present disclosure, a steel sheet that can be suitably used for a seismic damper used to secure seismic resistance of a structure against an earthquake and a manufacturing method of the same may be provided.

Alternatively, according to another aspect of the present disclosure, a steel sheet for a seismic damper having a low yield strength and excellent low-temperature impact toughness and a manufacturing method of the same may be provided.

Various and beneficial merits and effects of the present disclosure are not limited to the descriptions above, and may be more easily understood in a process of describing specific exemplary embodiments in the present disclosure.

BEST MODE FOR INVENTION

Figure 1:
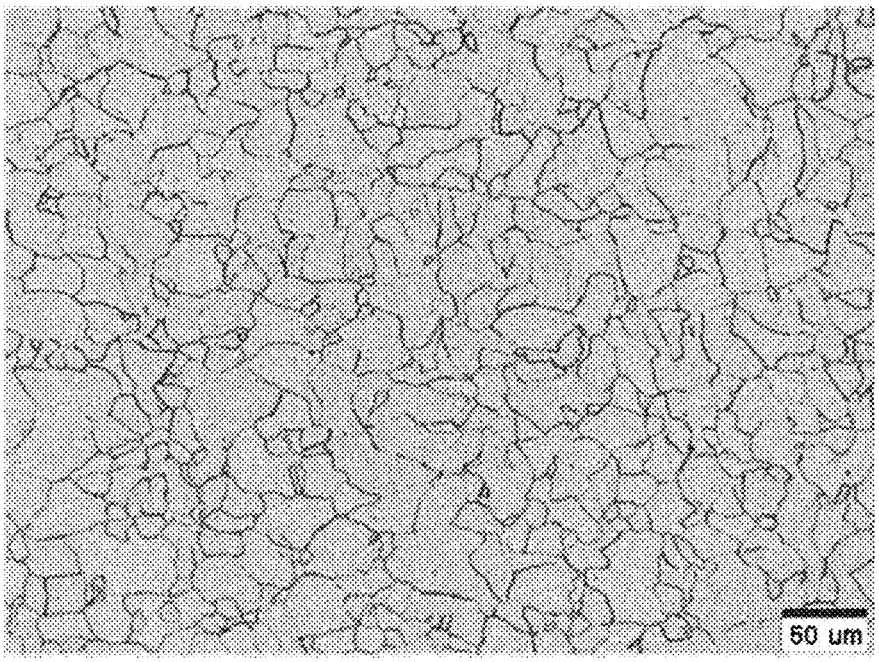
FIG. 1 illustrates a photograph of a microstructure inside a steel sheet according to an aspect of the present disclosure, captured with an optical microscope.

Hereinafter, preferred embodiments of the present disclosure will be described. However, embodiments of the present disclosure may be modified in various forms, and the scope of the present disclosure should not be construed as being limited to the embodiments described below. The present embodiments are provided to those skilled in the art to further elaborate the present disclosure.

As a steel material used to secure seismic resistance of a structure against an earthquake, conventionally, a technology of using a component close to pure iron and performing an additional heat treatment in a range of 910 to 960° C., has been known. However, since this technology requires performing an additional heat treatment at a high temperature of 900° C. or higher after finish rolling, excessive scale occurs in the case of a steel material having an ultra-low yield point to which Si is not added, so that defects occur, or coarse Nb or Ti precipitates are formed, so that there was a problem in that deterioration in impact toughness occurs. In addition, since an additional heat treatment process at a high temperature of 900° C. or higher is included, there is also a problem of causing an increase in manufacturing costs.

Alternatively, as a conventional steel material for a seismic damper, there has been a technology for controlling to have a coarse ferrite structure by utilizing ultra-low carbon steel, but this technology shows continuous yield behavior in which the yield point phenomenon does not occur during a tensile test. For this reason, work hardening occurs rapidly while absorbing plastic strain energy generated by an earthquake, resulting in a large increase in yield strength, so that there was a problem that needs to be improved as a steel sheet for a seismic damper for absorbing earthquake energy.

Accordingly, as a result of the examples thereof, the present inventors have developed a steel sheet for a seismic damper having a low yield strength and excellent low-temperature impact toughness, exhibiting a yield point phenomenon, resulting in completing a technology that can suppress an increase in yield strength by lowering rapid work hardening due to plastic deformation in the event of an earthquake.

Specifically, a steel sheet for a seismic damper according to an aspect of the present disclosure includes a base steel plate; and a scale layer formed on at least one surface of the base steel sheet.

In this case, the base steel sheet may include, by wt %, 0.005 to 0.02% of C, 0.05 to 0.2% of Si, 0.1 to 0.5% of Mn, 0.02% or less of P, 0.01% or less of S, 0.005 to 0.05% of Al, 0.005% or less of N, 0.02 to 0.06% of Nb, 48/14×[N] to 0.05% of Ti, with a balance of Fe and other unavoidable impurities.

Hereinafter, a reason for adding each alloy component constituting the composition of the base steel sheet, which is one of the main characteristics of the present invention, and an appropriate content range thereof will be first described.

C: 0.005 to 0.02%

C is an element causing solid solution strengthening and is fixed to dislocations in a free state to increase yield strength and decrease elongation. Therefore, in order to be suitably used as a steel material for a seismic damper, a C content needs to be controlled to 0.005% or more, and when the C content exceeds 0.02%, an appropriate strength for use as a seismic damper may be exceeded. Therefore, in the present disclosure, the C content is controlled to be 0.005 to 0.02%. However, more preferably, a lower limit of the C content may be 0.011%, or an upper limit of the C content may be 0.018%.

Si: 0.05 to 0.2%

Si, like C, is an element causing solid solution strengthening, and increases yield strength and lowers elongation, in order to be suitably used as a steel for a seismic damper, it is preferred to lower a Si content as much as possible. However, if Si is not added in an appropriate amount, adhesion of secondary scale generated during rolling is poor, so that the scale is formed on a surface of the steel sheet during production, increasing possibility of surface defects. Therefore, in the present disclosure, a Si content is controlled to 0.05% or more in terms of securing the adhesion of the secondary scale, and the Si content is controlled to 0.2% or less in terms of securing low yield strength. However, more preferably, a lower limit of the Si content may be 0.07%, or an upper limit of the Si content may be 0.15%.

Mn: 0.1 to 0.5%

Mn, like Si, is an element causing solid solution strengthening, to increase yield strength and lower elongation. Therefore, in order to be suitably used as a steel material for a seismic damper, in the present disclosure, a Mn content is controlled to 0.1% or more in terms of securing appropriate strength, and an upper limit thereof is controlled to 0.5% or less in order to avoid excessive solid solution strengthening effects. However, more preferably, a lower limit of the Mn content may be 0.18%, and the upper limit of the Mn content may be 0.35%.

P: 0.02% or Less (Excluding 0%)

P is an element that is advantageous for strength improvement and corrosion resistance, but it can greatly impair impact toughness, so it is preferable to maintain a P content to be as low as possible. Therefore, in the present disclosure, the P content may be controlled to 0.02% or less, more preferably 0.013% or less. In addition, as a lower limit of the P content, 0% may be excluded, considering an inevitably incorporated case, and more preferably, the lower limit of the P content may be 0.0005%.

S: 0.01% or Less (Excluding 0%)

Since S is an element that forms MnS, and the like to greatly impair impact toughness, it is preferable to keep an S content as low as possible. Therefore, in the present disclosure, the S content may be controlled to be 0.01% or less, more preferably 0.004% or less. In addition, as a lower limit of the S content, 0% may be excluded considering an inevitably incorporated case, and more preferably, the lower limit of the S content may be 0.0005% or more.

Al: 0.005 to 0.05%

Al is an element capable of inexpensively deoxidizing molten steel, and an upper limit of an Al content is controlled to 0.05% in terms of securing impact toughness while sufficiently lowering yield strength. Alternatively, more preferably, the upper limit of the Al content may be controlled to 0.035%, and a lower limit of the Al content may be controlled to 0.005% in terms of securing the minimum deoxidation performance. However, more preferably, the lower limit of the Al content may be 0.01%, and the upper limit of the Al content may be 0.035%.

N: 0.005% or Less (Excluding 0%)

N is an element causing solid solution strengthening and is fixed to dislocations in a free state to increase yield strength and decrease elongation. Therefore, the lower an N content, the better, so the N content is controlled to be 0.005% or less in terms of securing low yield strength. However, as a lower limit of the N content, 0% may be excluded considering an inevitably incorporated case, and more preferably, the lower limit of the N content may be 0.001% or more.

Nb: 0.02 to 0.06%

Nb is an important element in manufacturing TMCP steel, and is an element precipitated in a form of NbC or NbCN. In addition, Nb dissolved during reheating to a high temperature suppresses recrystallization of austenite, thereby exhibiting an effect of refining the structure.

Meanwhile, 0.02% or more of Nb is preferably added in order to promote desired deformation of organic precipitates. In addition, it is preferable to add Nb to 0.06% or less in order to prevent deterioration of impact toughness due to coarsening of precipitates. However, more preferably, a lower limit of the Nb content may be 0.03%, and an upper limit of the Nb content may be 0.05%.

Ti: 48/14×[N]~0.05%

Ti is an element that serves to prevent N from being fixed to dislocations by precipitating in a form of TiN. Therefore, in order to adhere N in steel in an appropriate range, considering the added N content (weight %), Ti should be added in an amount of 48/14×[N]% or more, where [N] refers to a content (weight %) of N in the base steel sheet.

Meanwhile, when Ti is excessively added, there is a concern that impact toughness may deteriorate due to coarsening of precipitates, so Ti is controlled to 0.05% or less in terms of securing impact toughness. However, more preferably, a lower limit of the Ti content may be 0.02%, and an upper limit of the Ti content may be 0.045%.

Meanwhile, although not particularly limited, according to an aspect of the present disclosure, the base steel sheet satisfies the following Relational Expression 1.

$$0.001 \leq [C]-12/93\times[Nb]-12/48\times[A] \leq 0.01 \quad \text{[Relational Expression 1]}$$

In Relational Expression 1, [C] represents an average content (weight %) of C in the base steel sheet, [Nb] represents an average content (weight %) of Nb in the base steel sheet, and [A] represents a value defined by the following Relational Expression 2.

$$[A]=[Ti]-48/12\times[N] \quad \text{[Relational Expression 2]}$$

In Relational Expression 2, [Ti] represents an average content (weight %) of Ti in the base steel sheet, and [N] represents an average content (weight %) of N in the base steel sheet.

According to an aspect of the present disclosure, a value of Free C expressed as [C]−12/93×[Nb]−12/48×[A] may be controlled in a range of 0.001 to 0.01%. When the value of Free C described above is less than 0.001%, it may be difficult that a yield point phenomenon is expressed, and the value thereof exceeds 0.01%, there is a risk of exceeding the appropriate strength that can be suitably used for the purpose of the seismic damper. That is, in the present disclosure, by satisfying the Relational Expression 1, it is possible to obtain a steel sheet in which excessive work hardening does not occur when an earthquake occurs by promoting the expression of an upper yield point.

Therefore, according to the present disclosure, it is possible to provide a steel sheet for a seismic damper having excellent low-temperature impact toughness, having a yield strength in a range of 205 to 245 MPa, a tensile strength of 300 MPa or more, and a Charpy impact transition temperature of −20° C. or lower.

In the present disclosure, remainder is Fe. However, since in the common manufacturing process, unintended impurities may be inevitably incorporated from raw materials or the surrounding environment, the component may not be excluded. Since these impurities are known to any person skilled in the common manufacturing process, the entire contents thereof are not particularly mentioned in the present specification.

According to an aspect of the present disclosure, the base steel sheet may include by area fraction, 95% or more (more preferably 99% or more) of ferrite as a microstructure, with a balance of 5% or less (including 0%) of other phases such as pearlite, or the like. Alternatively, most preferably, the base steel sheet has a single structure of ferrite (i.e., the base steel sheet includes, by area fraction, 100% of ferrite as a microstructure. By satisfying this, it is possible to effectively absorb energy when an earthquake occurs and serve as an earthquake damper.

In addition, although not particularly limited, according to an aspect of the present disclosure, in the base steel sheet, the average ferrite grain size may be in a range of 20 to 50 μm, more preferably 30 to 50 μm. In the base steel sheet, if the average ferrite grain size is less than 20 μm, a problem of exceeding a target yield strength may occur for use as a seismic damper. In the base steel sheet, when the average ferrite grain size exceeds 50 μm, dislocations can easily move due to the coarse ferrite grain size, resulting in a problem of exhibiting continuous yield behavior.

Based on a cutting surface of the steel material in the thickness direction (i.e., a direction perpendicular to a rolling direction), the average ferrite grain size described above refers to an average value of values obtained by measuring an equivalent circle diameter of the grains, and specifically, assuming that a spherical particle drawn with the longest length penetrating an inside of the grain as a particle diameter, the average ferrite grain size described above is an average value of the measured grain sizes.

Meanwhile, according to the present disclosure, a scale layer may be formed on at least one surface of the base steel sheet. In this case, although not particularly limited thereto, the scale layer may refer to a layer formed of FeO, $Fe_2SiO_4$, $Fe_2O_3$, $Fe_3O_4$, oxides of other alloying elements, and the like. depending on conditions in the manufacturing process of the steel sheet.

According to an aspect of the present disclosure, in the scale layer, a total content of FeO and $Fe_2SiO_4$ may be 2 to 5%, by wt %. When the total content of FeO and $Fe_2SiO_4$ is less than 2% by wt % with respect to the total content of the scale layer, the adhesion of the scale layer may deteriorate, resulting in irregular peeling of scale on the surface thereof. On the other hand, when the total content of FeO and $Fe_2SiO_4$ with respect to the total content of the scale layer exceeds 5%, the yield strength may exceed 245 MPa. In terms of further improving the effect described above, a lower limit of the total content of FeO and $Fe_2SiO_4$ with respect to the total content of the scale layer may be 2.28%, or the upper limit of the total content of FeO and $Fe_2SiO_4$ with respect to the total content of the scale layer may be 4%.

Meanwhile, although not particularly limited, according to an aspect of the present disclosure, in order to further improve the effect of providing the steel sheet for a seismic damper securing low yield strength and excellent low-temperature impact toughness and exhibiting the yield point phenomenon, and securing the adhesion of the scale layer to have excellent surface properties, the content of FeO in the scale layer may be 0.5 to 2%, by wt %, and/or the content of $Fe_2SiO_4$ in the scale layer may be 1 to 4.5%, by wt %. Alternatively, in terms of maximizing the effect described above, a lower limit of the content of FeO in the scale layer may be 0.79%, or an upper limit of the content of FeO in the scale layer may be 1.5%. Alternatively, in terms of maximizing the effect described above, a lower limit of the content of FeO in the scale layer may be 0.79%, or an upper limit of the content of FeO in the scale layer may be 1.5%.

In addition, according to an aspect of the present disclosure, a ratio (W1/W2) of a $Fe_2SiO_4$ content (W1) and a FeO content (W2) in the scale layer may be 1 to 9. In the scale layer, when the ratio of W1/W2 is less than 1.0, a problem of weakening adhesion of scale due to an insufficient ratio of $Fe_2SiO_4$ may occur, and when the ratio of W1/W2 exceeds 9, a problem of red scale may occur on the surface of the steel sheet. In terms of further improving effect described above, a lower limit of the ratio (W1/W2) may be 1.06, or an upper limit of the ratio (W1/W2) may be 4.

In addition, according to an aspect of the present disclosure, an average thickness of the scale layer may be 10 to 100 μm. When the average thickness of the scale layer is less than 10 μm, a problem of weakening the adhesion of the scale may occur, and when the average thickness exceeds 100 μm, a problem in processing may occur. Meanwhile, in order to further improve the effect described above, a lower limit of the average thickness of the scale layer may be 31 μm, or an upper limit of the average thickness of the scale layer may be 45 μm.

Hereinafter, a manufacturing method of a steel sheet for a seismic damper according to another aspect of the present disclosure will be described in detail. However, the manufacturing method of the steel sheet for a damper a seismic damper of the present disclosure does not necessarily mean that it must be manufactured by the following manufacturing method.

Slab Reheating Operation

A manufacturing method of a steel material for a seismic damper according to an aspect of the present disclosure may include an operation of reheating a steel slab satisfying the composition described above, wherein the reheating may be performed to a temperature within a range of 1050 to 1250° C. In this case, a heating temperature of the steel slab is controlled to be 1050° C. or higher in order to sufficiently dissolve a carbonitride of Ti and/or Nb formed during casting. However, when heated to an excessively high temperature, there may a concern of coarsening austenite, and it takes an excessive amount of time for a temperature of a surface thereof after rough rolling to reach a cooling start temperature of a surface layer portion, the slab may be preferably heated at 1250° C. or lower.

Descaling Operation after the Reheating Operation

When reheating the slab described above, oxides generated in a heating furnace may penetrate into a surface of the steel slab and deteriorate adhesion of a finally formed scale layer. Therefore, in order to improve surface quality through securing good adhesion of the scale layer, before a rough rolling operation after the reheating operation, high-pressure water having a pressure of 150 to 200 bars may be provided to the surface of the steel slab to perform a descaling treatment.

Rough Rolling Operation

According to an aspect of the present disclosure, before a finish rolling operation to be described later, the reheated steel slab may further include an operation of performing rough rolling to adjust a shape of the slab, and a temperature during rough rolling may be controlled to a temperature at which recrystallization of austenite stops (Tnr+50°) C or higher. It is possible to obtain an effect of destroying structural structures such as dentrite, or the like, formed during casting by rough rolling, and it is also possible to obtain an effect of reducing a size of austenite. Meanwhile, more preferably the rough rolling may be performed in a range of 999 to 1155° C.

Secondary Descaling Operation after the Rough Rolling Operation

Meanwhile, not only in the reheating operation of the slab described above, but also in the rough rolling operation, oxides formed on a surface of the rough-rolled bar may penetrate thereinto and affect adhesion of a finally-formed scale layer. Therefore, in the present disclosure, in order to improve surface quality through securing good adhesion of the scale layer, before a hot rolling operation after the rough rolling operation, high-pressure water having a pressure of 150 to bars may be selectively provided to a surface of the rough-rolled bar, to perform a descaling treatment, and the pressure of the high-pressure water in an operation of the secondary descaling treatment may be controlled to be within a range of 1 to 1.2 times the pressure of the high-pressure water in an operation of the primary descaling treatment. More preferably, the pressure may be controlled to be within a range of 1.02 to 1.2 times.

Hot Rolling Operation

The rough-rolled bar described above may be hot-rolled in a temperature range of Tnr or higher, and may be cooled by air cooling after the hot rolling.

Figure 3:
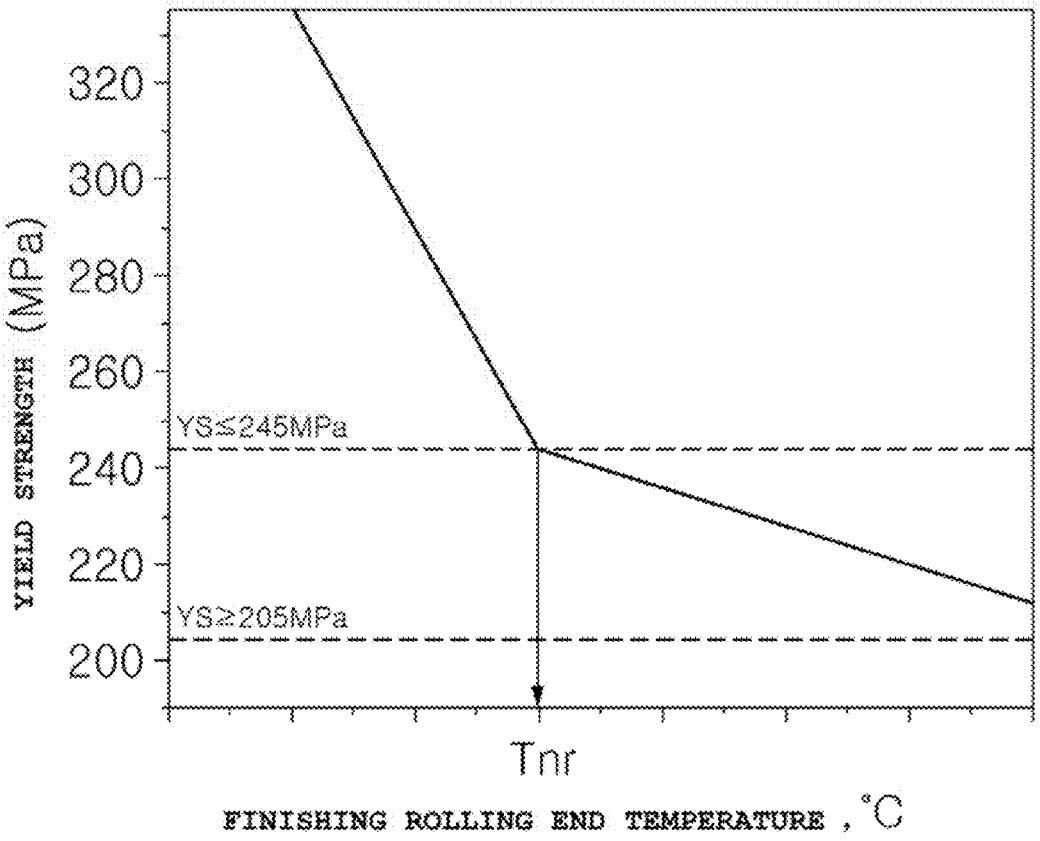
FIG. 3 is a graph illustrating a change in yield according to a hot rolling end temperature in the present disclosure.

When the hot rolling temperature is lower than Tnr, as illustrated in FIG. 3, a large amount of non-uniform deformation zone is introduced into austenite grains to act as a ferrite nucleation site, and fine ferrite is transformed, so that a yield strength may exceed 245 MPa. That is, when the hot rolling temperature is lower than the non-recrystallization stop temperature Tnr, the yield strength exceeds 245 MPa due to a rapid increase in yield strength. Therefore, a rolling end temperature should be higher than the non-recrystallization stop temperature (Tnr). In this case, the Tnr is not separately defined in the present disclosure since a Tnr formula used in normal ultra-low carbon steel is equally applicable. Meanwhile, according to an aspect of the present disclosure, the hot rolling may be performed in a temperature range of 922 to 962° C.

MODE FOR INVENTION

Hereinafter, the present disclosure will be specifically described through the following Examples. However, it should be noted that the following examples are only for describing the present disclosure by illustration, and not intended to limit the right scope of the present disclosure. The reason is that the right scope of the present disclosure is determined by the matters described in the claims and reasonably inferred therefrom.

Experimental Example 1

A steel slab having the alloy composition and properties illustrated in Table 1 below was prepared. In this case, a content of each component in Table 1 below is represented by wt %, and a balance thereof is Fe and inevitable impurities. That is, in the steel slabs described in Tables 1 and 2 below, Inventive Steels A to D illustrate an example matching a range of alloy compositions defined by the present disclosure, and Comparative Steels E to I illustrate an example deviating from the range of alloy compositions defined by the present disclosure.

After reheating the prepared steel slab in a temperature range of 1050 to 1250° C., slab reheating-rough rolling-hot rolling were performed under the conditions illustrated in Table 3 below to manufacture a steel material. In this case, before rough rolling after the reheating, high pressure water having a pressure of 150 bars was provided on a surface of the slab to perform a primary descaling treatment, and before hot rolling after the rough rolling, high pressure water having a pressure of 180 bars was provided on a surface of the rough-rolled bar to perform a secondary descaling treatment.

TABLE 1

| Steel type | C | Si | Mn | P | S | Al | Ti | Nb | N |
|---|---|---|---|---|---|---|---|---|---|
| Inventive Steel A | 0.011 | 0.12 | 0.25 | 0.009 | 0.003 | 0.03 | 0.021 | 0.04 | 0.0035 |
| Inventive Steel B | 0.018 | 0.15 | 0.35 | 0.001 | 0.004 | 0.027 | 0.025 | 0.03 | 0.0017 |
| Inventive Steel C | 0.015 | 0.08 | 0.21 | 0.012 | 0.002 | 0.023 | 0.03 | 0.05 | 0.0025 |
| Inventive Steel D | 0.013 | 0.07 | 0.18 | 0.013 | 0.003 | 0.035 | 0.041 | 0.03 | 0.0032 |
| Comparative Steel E | 0.003 | 0.1 | 0.32 | 0.014 | 0.002 | 0.035 | 0.025 | 0.04 | 0.0038 |
| Comparative Steel F | 0.03 | 0.15 | 0.21 | 0.013 | 0.001 | 0.04 | 0.016 | 0.05 | 0.0021 |
| Comparative Steel G | 0.015 | 0.35 | 0.15 | 0.011 | 0.003 | 0.024 | 0.035 | 0.01 | 0.0015 |
| Comparative Steel H | 0.02 | 0.09 | 0.33 | 0.016 | 0.004 | 0.03 | 0.056 | 0.02 | 0.0021 |
| Comparative Steel I | 0.013 | 0.01 | 0.17 | 0.015 | 0.002 | 0.025 | 0.023 | 0.03 | 0.0023 |

TABLE 2

| Steel type | [A]* | Free C* | Tnr [° C.] |
|---|---|---|---|
| Inventive Steel A | 0.007 | 0.004 | 938 |
| Inventive Steel B | 0.018 | 0.010 | 921 |
| Inventive Steel C | 0.02 | 0.003 | 951 |
| Inventive Steel D | 0.028 | 0.002 | 922 |
| Comparative Steel E | 0.010 | −0.005 | 937 |
| Comparative Steel F | 0.008 | 0.022 | 952 |
| Comparative Steel G | 0.029 | 0.006 | 932 |
| Comparative Steel H | 0.048 | 0.005 | 935 |
| Comparative Steel I | 0.014 | 0.006 | 931 |

[A]* = [Ti] − 48/12 × [N]
Free C* = [C] − 12/93 × [Nb] − 12/48 × [A]

TABLE 3

| | | Conditions | | | | Hot rolling condition | | |
|---|---|---|---|---|---|---|---|---|
| Steel type | No. | Product thickness [mm] | Slab thickness [mm] | Reheating extraction temperature [° C.] | Rough rolling end temperature [° C.] | Rolling start temperature [° C.] | Rolling end temperature [° C.] | Remarks |
| Inventive Steel A | A-1 | 30 | 285 | 1150 | 1050 | 995 | 939 | Recommended conditions |
| | A-2 | 20 | 295 | 1115 | 1035 | 1021 | 940 | Recommended conditions |

TABLE 3-continued

| Steel type | No. | Conditions: Product thickness [mm] | Slab thickness [mm] | Reheating extraction temperature [° C.] | Rough rolling end temperature [° C.] | Hot rolling condition: Rolling start temperature [° C.] | Rolling end temperature [° C.] | Remarks |
|---|---|---|---|---|---|---|---|---|
| | A-3 | 35 | 280 | 1135 | 995 | 945 | 872 | Hot rolling end temperature being less than Tnr |
| Inventive Steel B | B-1 | 20 | 280 | 1175 | 1015 | 995 | 923 | Recommended conditions |
| | B-2 | 25 | 285 | 1125 | 1002 | 985 | 922 | Recommended conditions |
| | B-3 | 30 | 255 | 1085 | 975 | 915 | 865 | Hot rolling end temperature being less than Tnr |
| Inventive Steel C | C-1 | 25 | 285 | 1155 | 1155 | 1085 | 952 | Recommended conditions |
| | C-2 | 20 | 280 | 1125 | 1055 | 1011 | 962 | Recommended conditions |
| | C-3 | 18 | 275 | 1110 | 1054 | 970 | 870 | Hot rolling end temperature being less than Tnr |
| Inventive Steel D | D-1 | 40 | 295 | 1135 | 999 | 985 | 925 | Recommended conditions |
| | D-2 | 25 | 285 | 1145 | 1010 | 989 | 923 | Recommended conditions |
| | D-3 | 32 | 280 | 1130 | 995 | 970 | 865 | Hot rolling end temperature being less than Tnr |
| Comparative Steel E | E-1 | 40 | 255 | 1115 | 1000 | 975 | 938 | Recommended conditions |
| Comparative Steel F | F-1 | 24 | 290 | 1135 | 1095 | 1020 | 955 | Recommended conditions |
| Comparative Steel G | G-1 | 15 | 295 | 1130 | 1035 | 985 | 935 | Recommended conditions |
| Comparative Steel H | H-1 | 25 | 285 | 1125 | 1005 | 995 | 940 | Recommended conditions |
| Comparative Steel I | I-1 | 30 | 290 | 1135 | 1015 | 995 | 935 | Recommended conditions |

After manufacturing a steel sheet under the conditions described in Table 3 above, the steel sheet thus obtained was polishing-etched and then observed with an optical microscope. Therefore, it was confirmed that the base steel sheet has a ferrite single structure.

Figure 2:
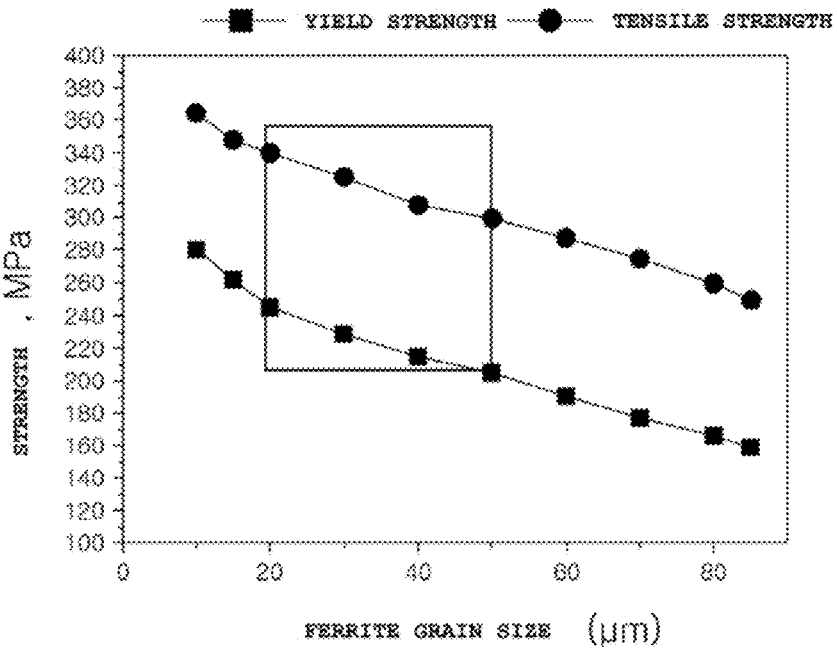
FIG. 2 is a graph illustrating a change in yield strength and tensile strength accord no to a ferrite grain size in a steel material according to the present disclosure.

In addition, the results of measuring an average ferrite grain size, yield strength (YS), tensile strength (TS), and Charpy impact transition temperature of the steel sheet obtained from each Experimental Example were shown in Table 4 below. In this case, target ranges of the yield strength and tensile strength corresponding to the strength characteristic range desired in the present disclosure were shown in FIG. 2, together with the ferrite grain size.

In addition, an average thickness of the scale layer was measured by being imaged with an optical microscope to observe the scale layer, which was shown in Table 4 below. In addition, a content of FeO and $Fe_2SiO_4$ in the scale layer were measured using a scanning electron microscope and EDS, which was shown in Table 4 below.

In this case, the average ferrite grain size was measured using a line measurement method, and a point at which yielding occurs using a tensile tester was set to be a yield strength, and a strength when necking occurs was set to be tensile strength. For a Charpy impact transition temperature, an impact absorption energy was measured using a Charpy impact tester and a temperature at which fracture transitions from ductility to brittleness was shown.

Additionally, in order to evaluate surface properties of the steel sheet, a surface of the steel sheet having an area of 1 $m^2$ was observed with a naked eye, and then a peeling area of the scale layer was measured and evaluated according to the following criteria.

○: a peeling area of the scale layer was 20% or less

Δ: a peeling area of the scale layer exceeded 20% and 40% or less x: a peeling area of the scale layer exceeded 20%

TABLE 4

| No. | Division | Base steel sheet: Ferrite fraction [%] | Base steel sheet: Average grain size [μm] | Scale layer: FeO content [wt %] | Scale layer: $Fe_2SiO_4$ [wt %] | Scale layer: Total content of FeO and $Fe_2SiO_4$ [wt %] | Scale layer: Average thickness of scale layer [μm] |
|---|---|---|---|---|---|---|---|
| A-1 | Example 1-1 | 98 | 43 | 1.1 | 2.3 | 3.4 | 38 |
| A-2 | Example 1-2 | 99 | 39 | 1.09 | 2.26 | 3.35 | 34 |
| A-3 | Reference Example 1 | 97 | 22 | 1.08 | 2.3 | 3.38 | 17 |
| B-1 | Example 2-1 | 98 | 43 | 0.85 | 3.15 | 4 | 38 |
| B-2 | Example 2-2 | 99 | 36 | 0.79 | 3.16 | 3.95 | 31 |
| B-3 | Reference Example 2 | 97 | 16 | 0.78 | 3.2 | 3.98 | 11 |
| C-1 | Example 3-1 | 98 | 44 | 1.2 | 1.39 | 2.59 | 39 |
| C-2 | Example 3-2 | 96 | 50 | 1.21 | 1.39 | 2.6 | 45 |
| C-3 | Reference Example 3 | 99 | 20 | 1.3 | 1.31 | 2.61 | 15 |
| D-1 | Example 4-1 | 98 | 39 | 1.05 | 1.23 | 2.28 | 34 |
| D-2 | Example 4-2 | 97 | 43 | 1.11 | 1.18 | 2.29 | 38 |
| D-3 | Reference Example 4 | 97 | 16 | 1.15 | 1.15 | 2.3 | 11 |
| Comparative Steel F | Comparative Example 1 | 98 | 44 | 1.3 | 1.69 | 2.99 | 39 |
| Comparative Steel F | Comparative Example 2 | 99 | 31 | 1.25 | 1.66 | 2.91 | 26 |
| Comparative Steel G | Comparative Example 3 | 98 | 36 | 0.7 | 7.8 | 8.5 | 31 |
| Comparative Steel H | Comparative Example 4 | 99 | 45 | 1.12 | 1.72 | 2.84 | 40 |
| Comparative Steel I | Comparative Example 5 | 98 | 46 | 0.4 | 0.34 | 0.85 | 85 |

TABLE 5

| Division | Occurrence of yield point phenomenon | YS [MPa] | TS [MPa] | Charpy impact transition temperature [° C.] | Surface characteristics evaluation |
|---|---|---|---|---|---|
| Example 1-1 | Occur | 212 | 307 | −45 | ○ |
| Example1-2 | Occur | 219 | 313 | −50 | ○ |
| Reference Example 1 | No occur | 265 | 357 | −35 | ○ |
| Example 2-1 | Occur | 214 | 308 | −38 | ○ |
| Example 2-2 | Occur | 224 | 317 | −37 | ○ |
| Reference Example 2 | No occur | 275 | 365 | −40 | ○ |
| Example 3-1 | Occur | 211 | 306 | −37 | ○ |
| Example 3-2 | Occur | 202 | 300 | −41 | ○ |
| Reference Example 3 | No occur | 275 | 369 | −28 | ○ |
| Example 4-1 | Occur | 219 | 313 | −37 | ○ |
| Example 4-2 | Occur | 214 | 308 | −51 | ○ |
| Reference Example 4 | No occur | 296 | 354 | −41 | ○ |
| Comparative Example 1 | No occur | 203 | 306 | −26 | ○ |

TABLE 5-continued

| Division | Occurrence of yield point phenomenon | YS [MPa] | TS [MPa] | Charpy impact transition temperature [° C.] | Surface characteristics evaluation |
|---|---|---|---|---|---|
| Comparative Example 2 | Occur | 255 | 345 | −21 | ○ |
| Comparative Example 3 | Occur | 263 | 352 | −25 | ○ |
| Comparative Example 4 | Occur | 196 | 305 | −8 | ○ |
| Comparative Example 5 | Occur | 193 | 301 | −23 | x |

As can be seen in Table 5, Examples satisfying both the steel composition and manufacturing conditions of the present disclosure, exhibited a yield point phenomenon and physical properties of the steel material had a yield strength of 205 to 245 MPa, tensile strength of 300 MPa or more, and Charpy impact transition temperature of −20° C. or lower.

In addition, in all the steel sheets obtained from the embodiments of the present disclosure, a total content of FeO and $Fe_2SiO_4$ in the scale layer satisfies a range of 2 to 5%, by wt %, and thereby, adhesion was excellent without peeling of the scale layer, so excellent surface properties were confirmed. It is determined that this is because $SiO_2$ formed at a boundary between the scale and a base material reacts with FeO to form $Fe_2SiO_4$ (Fayalite), which increases binding force between the scale and the base material, resulting in a stable scale state.

In particular, with respect to the steel sheet obtained from Example 1-1, a photograph of a microstructure captured with an optical microscope is shown in FIG. 1. As can be seen in FIG. 1, the microstructure of the steel sheet is a ferrite single structure, and it could be confirmed that an average ferrite grain size was in a range of 20 to 50 μm.

Figure 5:
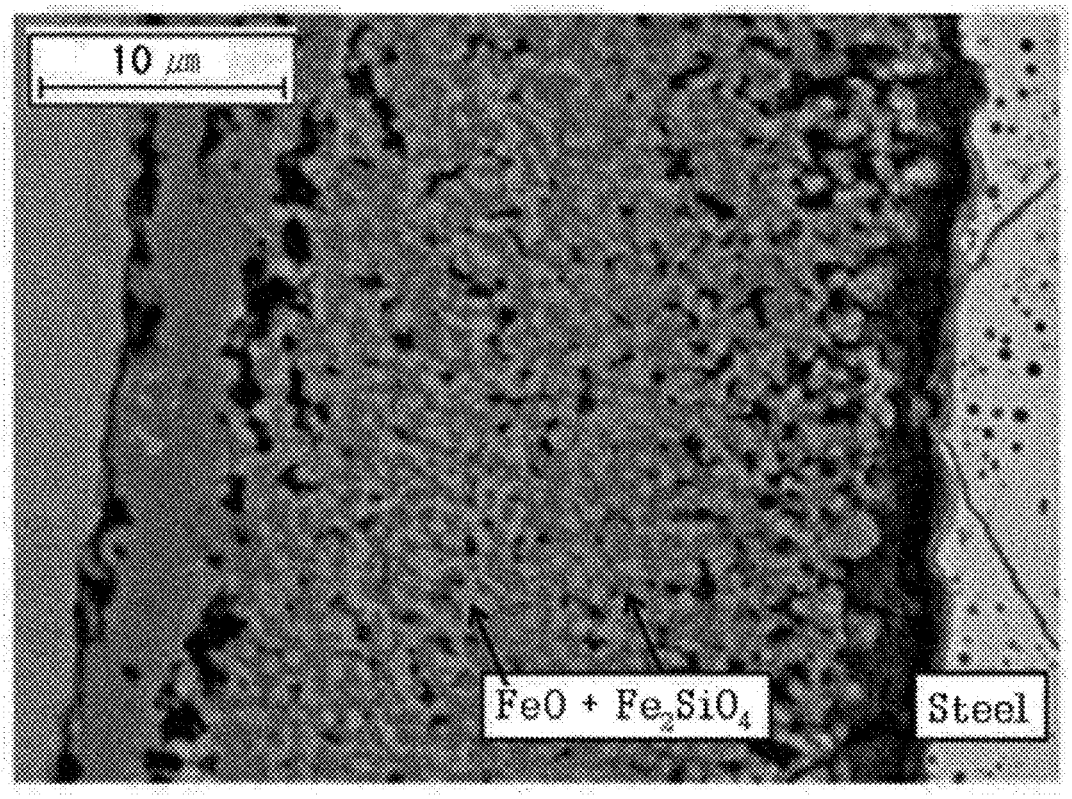
FIG. 5 is an optical photograph illustrating distribution of $FeO+Fe_2SiO_4$ in a scale layer formed on an upper layer of the base steel sheet in the present disclosure, as a photograph illustrating a cross-section of the scale layer formed on the surface of the base steel sheet after completion of rolling.

In addition, with respect to the steel sheet obtained from Example 1-1, after being manufactured so that a cross-section thereof in the thickness direction so that the scale layer can be observed, a photograph captured with an optical microscope was shown in FIG. 5. Thereby, it was confirmed that $FeO+Fe_2SiO_4$ was included in the scale layer formed on the base steel sheet.

On the other hand, in Comparative Example 1, a C content was less than a lower limit specified in the present disclosure, and a value of Free C was insufficient, resulting in continuous yield, and the yield strength was less than 205 MPa.

In Comparative Example 2, the C content exceeded the content specified, so that the yield strength exceeded 245 MPa.

In Comparative Example 3, Si was added excessively, and the yield strength exceeded 245 MPa.

Comparative Example 4 showed a case in which the manufacturing conditions of the present disclosure are all satisfied, but a Ti content exceeded an upper limit specified in the present disclosure, and in Comparative Example 5, the Charpy impact transition temperature exceeded −20° C. due to the formation of coarse precipitates.

Figure 4:
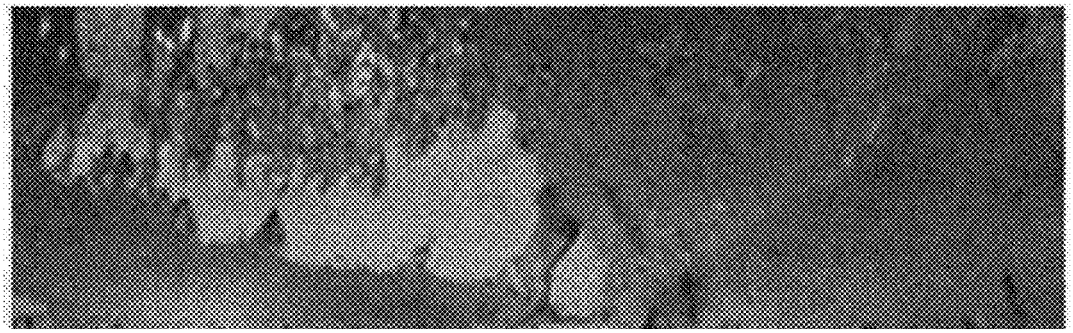
FIG. 4 illustrates adhesion of a scale layer formed on a surface of a base steel sheet after completion of rolling in the present disclosure, which is a photograph illustrating a shape of the scale layer dropping due to poor adhesion.

In Comparative Example 5, the yield strength was less than 205 MPa due to an insufficient Si content specified in the present disclosure, and a total content of FeO and $Fe_2SiO_4$ in the scale layer was less than 2%, by wt %, confirming that the surface properties were deteriorated. In particular, a state in which the scale layer is peeled for Comparative Example 5 was shown in FIG. 4.

In addition, in the case of Reference Examples 1 to 4 satisfying the steel compositions of the present disclosure, but not satisfying the manufacturing conditions thereof, a case in which a hot rolling end temperature is less than Tnr was shown. In such Reference Examples 1 to 4, continuous yield behavior due to introduction of dislocations by rolling in a ferrite region, was shown and yield strengths all exceeded 245 MPa.

While example embodiments have been shown and described above, it will be apparent to those skilled in the art that modifications and variations could be made without departing from the scope of the present disclosure as defined by the appended claims.

The invention claimed is:

1. A steel sheet for a seismic damper, comprising:

a base steel sheet; and a scale layer formed on at least one surface of the base steel sheet, wherein the base steel sheet includes, by wt %, 0.005 to 0.02% of C, 0.05 to 0.2% of Si, 0.1 to 0.5% of Mn, 0.02% or less of P, 0.01% or less of S, 0.005 to 0.05% of Al, 0.005% or less of N, 0.02 to 0.06% of Nb, 48/14×[N] to 0.05% of Ti, with a balance of Fe and other unavoidable impurities, wherein a total content of FeO and $Fe_2SiO_4$ in the scale layer is 2 to 5%, by wt %.

2. The steel sheet for a seismic damper of claim 1, wherein a microstructure of the base steel sheet is a ferrite single structure.

3. The steel sheet for a seismic damper of claim 2, wherein the average ferrite grain size is 20 to 50 μm.

4. The steel sheet for a seismic damper of claim 1, wherein the base steel sheet satisfies the following Relational Expression 1, $$0.001 \leq [C]-12/93\times[Nb]-12/48\times[A] \leq 0.01 \quad \text{[Relational Expression 1]}$$

in Relational Expression 1, where [C] represents an average content (weight %) of C in the base steel sheet, [Nb] represents an average content (weight %) of Nb in the base steel sheet, and [A] represents a value defined by the following Relational Expression 2, $$[A]=[Ti]-48/12\times[N] \quad \text{[Relational Expression 2]}$$

in Relational Expression 2, where [Ti] represents an average content (weight %) of Ti in the base steel sheet, and [N] represents an average content (weight %) of N in the base steel sheet.

5. The steel sheet for a seismic damper of claim 1, wherein a content of FeO in the scale layer is 0.5 to 2% by wt %.

6. The steel sheet for a seismic damper of claim 1, wherein a content of $Fe_2SiO_4$ in the scale layer is 1 to 4.5%, by wt %.

7. The steel sheet for a seismic damper of claim 1, wherein a ratio (W1/W2) of the content (W1) of $Fe_2SiO_4$ and the content (W2) of FeO in the scale layer is 1 to 9.

8. The steel sheet for a seismic damper of claim 1, wherein the scale layer has an average thickness of 10 to 100 μm.

9. The steel sheet for a seismic damper of claim 1, wherein the steel sheet has a yield strength of 205 to 245 MPa.

10. The steel sheet for a seismic damper of claim 1, wherein the steel sheet has a tensile strength of 300 MPa or more.

11. The steel sheet for a seismic damper of claim 1, wherein the steel sheet has a Charpy impact transition temperature of −20° C. or lower.

* * * * *